United States Patent [19]

Murray

[11] Patent Number: 4,606,141

[45] **Date of Patent: * Aug. 19, 1986**

[54] INDICIA DISPLAY MODULE

[75] Inventor: Ledell L. Murray, Noblesville, Ind.

[73] Assignee: General Indicator Corporation, Pardeeville, Wis.

[ * ] Notice: The portion of the term of this patent subsequent to Jan. 7, 2003 has been disclaimed.

[21] Appl. No.: 708,234

[22] Filed: Mar. 5, 1985

Related U.S. Application Data

[63] Continuation of Ser. No. 552,295, Nov. 16, 1983, abandoned, which is a continuation-in-part of Ser. No. 424,151, Sep. 27, 1980, abandoned.

[51] Int. Cl.[4] ..... G09F 11/18

[52] U.S. Cl. ..... 40/518; 40/10 R

[58] Field of Search ..... 40/518, 10 R, 16, 489, 40/558, 576

[56] References Cited

U.S. PATENT DOCUMENTS

| | | | |
|---|---|---|---|
| 1,708,479 | 4/1929 | MacDonald | 40/518 |
| 2,563,580 | 8/1951 | Clark | 40/518 |
| 2,601,733 | 7/1952 | Durey | 40/518 |
| 2,764,826 | 10/1956 | Fulton et al. | 40/518 |
| 3,159,937 | 12/1964 | Barnes | 40/518 |
| 3,939,584 | 2/1976 | Trame | 40/518 |
| 4,095,359 | 6/1978 | Trame | 40/446 |
| 4,258,490 | 3/1981 | Trame | 40/518 |
| 4,296,563 | 10/1981 | Clement | 40/518 |
| 4,337,588 | 7/1982 | Clapper | 40/518 |

*Primary Examiner*—Robert Peshock
*Assistant Examiner*—Cary E. Stone
*Attorney, Agent, or Firm*—Bayard H. Michael

[57] ABSTRACT

The price display module has a clear plastic light transmission and support member mounted on the back of a bezel to display an indicia on the pre-coiled strip through the bezel aperture and illuminated by light reflected through the member from the back light source to the front of the member. The coiled ends of the strip are supported by and separated by the pipe so the illumination of the displayed indicia is uniform.

7 Claims, 5 Drawing Figures

INDICIA DISPLAY MODULE

This is a continuation of application Ser. No. 552,295 now abandoned which was a continuation-in-part of my application Ser. No. 424,151 abandoned.

BACKGROUND OF THE INVENTION

Fast food stores typically display the names of food items and prices on signs which are provided with back lighting. The prices are displayed on modules permitting changing the price. Typically, the numbers are on pre-coiled price strips which are supported so that when one of the numbers is displayed at an aperture in a bezel, the coils at each end of the strip are theoretically spread apart behind the displayed number to permit light to enter from the light source.

In practice, however, these coils tend to close behind the displayed number and cast shadows on the number. The coils cannot be held far apart since adjacent price modules would interfere. There is not much spare space between modules. Thus, the lighting is not uniform and the displayed numbers are darker than desirable.

U.S. Pat. No. 4,095,359 discloses such a price display module. That module is an open channel which in theory allows light to pass to the front but the coils hang over the ends of the channel legs and block some light. As the coils loosen with age, they block more light.

My copending application Ser. No. 423,692 shows a light pipe arrangement which is a great improvement over the arrangement of U.S. Pat. No. 4,095,359. But cost or other reasons may rule against the light pipe.

SUMMARY OF THE INVENTION

The principal object of this invention is to provide a light transmission and coil support member which improves upon the prior art to provide shadow free, uniform lighting of the displayed prices. This present structure does not improve upon or equal my light pipe design, but it approaches the quality of the light pipe at a saving in cost. Furthermore, the present design can be modified to retrofit the structure of U.S. Pat. No. 4,095,359 to upgrade the displayed image.

The present design uses an open channel-like member instead of the light pipe of my copending application. This invention accommodates the fact the coils have to lie within limited vertical space and inherently must lie in the horizontal light path from the fluorescent lights behind. The legs of the channel converge and then diverge going from the rear to the front. This forms troughs receiving the coils. The angle of convergence and divergence are selected to optimize light reflection so the inner surfaces of the legs reflect light much like the interior surfaces of the pipe. The legs of the channel serve to keep the coiled ends of the price strip apart while the member transmits light between the coiled ends to be emitted through the front of the channel and the strip. If used with U.S. Pat. No. 4,095,359 a module the channel member simply fits inside the structure of U.S. Pat. No. 4,095,359.

DETAILED DESCRIPTION OF THE DRAWINGS

Figure 1:
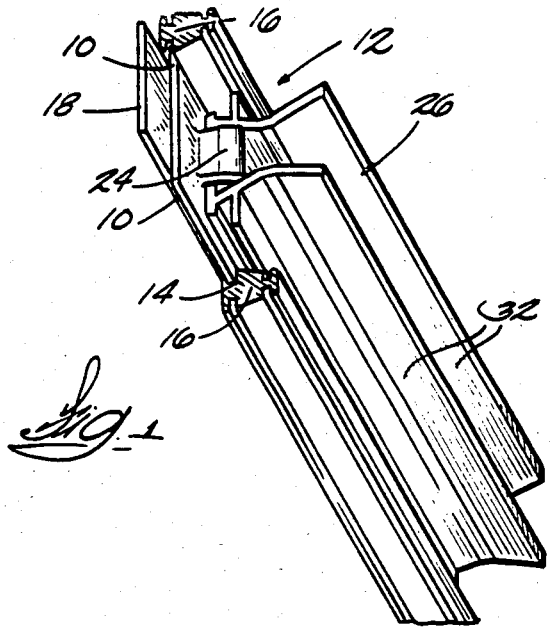
FIG. 1 is a perspective view, somewhat in schematic form in that the rails in which the bezel is mounted are shown only in part.
Figure 2:
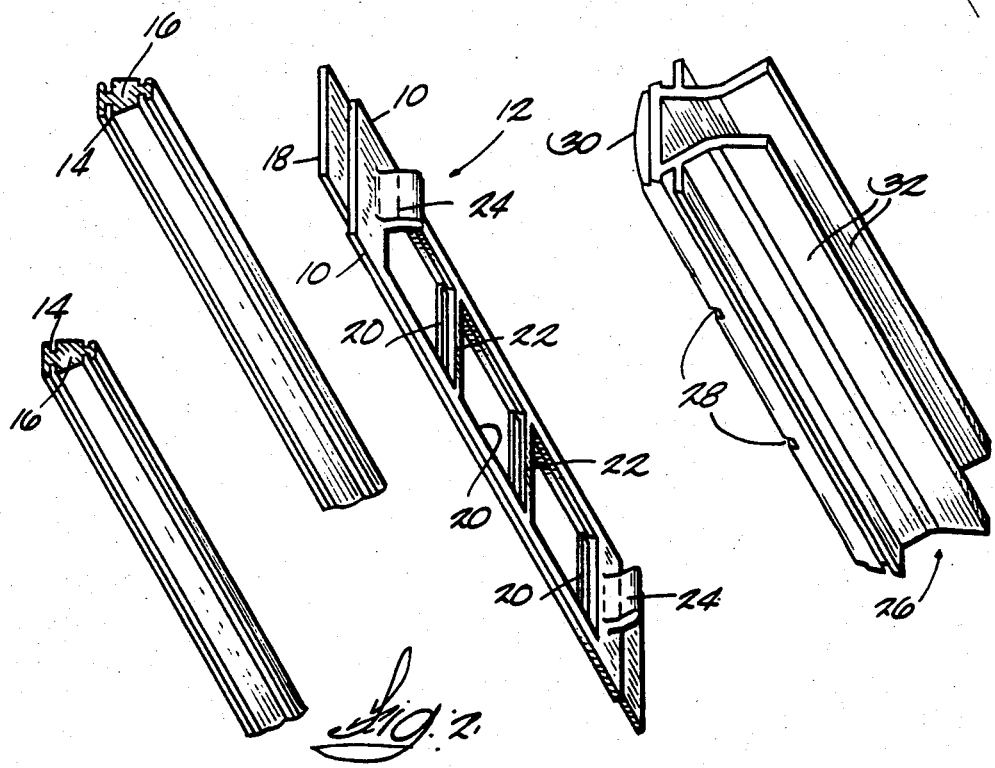
FIG. 2 is an exploded view of the parts shown in FIG. 1.
Figure 3:
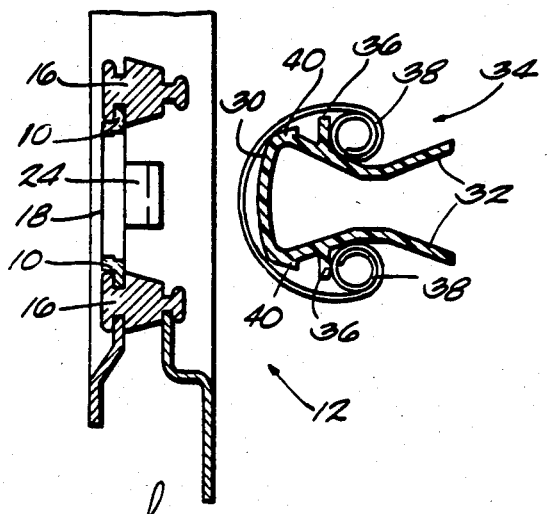
FIG. 3 is a cross section through the plastic support and light transmitting member with a coiled price strip in place but prior to mounting in the bezel.
Figure 4:
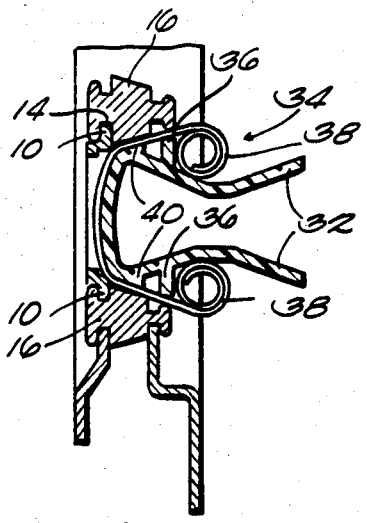
FIG. 4 is a cross-section view showing the manner in which the assembly imposes a friction load on the price strip.

The sides 10, 10 of the bezel 12 fit into grooves 14 of rails 16 fixed in the frame (not shown) to support the bezel with the front 18 between and flush with the fronts of the rails 16. The bezel has three apertures 20 separated by dividers 22 and has retaining fingers 24 which are adapted to snap over the ends of the support and light transmitting member 26 with slots 28 in the front surface of the member 26 fitting over dividers 22 with the front surfaces 30 of the support member 26 in registry with each of the bezel apertures.

The support member 26 is generally channel-like with the legs 32, 32 extending to the rear of the module and slightly kinked in towards each other so that they converge and then diverge towards the front surface. The angle of convergence and divergence is selected to insure that light entering the open rear end of the support member will be reflected within the space between the legs rather than passing out through the legs. The light comes from fluorescent tubes about 6" behind the module and may be regarded as traveling in a horizontal path. Therefore, the angle of convergence/divergence is $22\frac{1}{2}°$ which is the most efficient reflection angle off a polished surface. Greater or lesser angles are not as efficient. Indeed, if the angle of incidence is high the light passes through the plastic. Thus, when the direct or reflected light finally reaches the front of the support member, it strikes the back of the front surface 30 at a high angle of incidence and passes through the front surface to illuminate the pre-coiled price strip 34. The coiled ends of the strip are supported in the "troughs" behind the shelves 36 which prevent the coiled ends 38 from getting into and jamming in the converging space between the legs 32 and the beveled rails 16. The gap between the ends of the shelves 36 and the beveled rails and the gap between the guides 40 and the rails is selected to ensure the curl of the price strip will cause the strip to frictionally engage the rails and resist the tendency to move when the frame is vibrated.

The inside surface of legs 32, 32 could be silvered to increase light reflection but the increase in brightness does not justify the cost. The highly polished surface of the clear plastic of the support reflects a very high percentage of the light.

Figure 5:
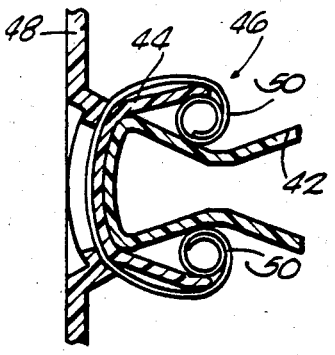
FIG. 5 is a cross section through a modified version which serves to retrofit and improve on the structure of U.S. Pat. No. 4,095,359.

The module shown in FIG. 5 is essentially the module shown in U.S. Pat. No. 4,095,359 with a retrofit channel member 42 mounted inside the standard clear, plastic support 44 made according to U.S. Pat. No. 4,095,359. The pre-coiled price strip 46 is now supported in the same manner as in the patent behind the aperture in bezel 48, but the coiled ends 50, 50 now rest in the "trough" formed by the support and light reflecting member 42. Thus, the member reflects and transmits light between the coiled ends 50, 50 and ensures a uniform light distribution over the face of the indicia displayed at the bezel 48. The coiled ends cannot cast a shadow on the displayed numerals because the light is reflected between the coiled ends.

In all cases the light transmitted through the front surface appears uniform to the observer and there is no appearance of shadows from the coiled strip behind. The reflecting surfaces "pipe" the light between the coils.

The legs converge and diverge at an angle of 22½° to maximize light transmission or piping to the front surface. Light rays striking the legs have the same angle of incidence and reflection and a plot shows that. With this shape all the light entering the open rear is transmitted to the front reduced only by the small loss found in reflecting off the polished surface. The light which strikes the rear of the front surface strikes at a high angle of incidence and is, therefore, transmitted through the front surface. Since the converging/diverging legs 32 "squeeze" the light between the coiled ends of the strip 34, there are no shadows on the display. The light across the front and the strip is uniform to the eye (a precise meter can detect a difference). Therefore, the display is not degraded by shadows as in the prior art.

I claim

1. A display module comprising, a bezel having an aperture therein, a light reflecting and support member mounted on the back of the bezel in alignment with the aperture, said light reflecting and support member being in the general shape of a U-shaped channel having spaced legs connected at one end by a cross member, said light reflecting and support member lying on its side with said cross member comprising the front of the light reflecting and support member while the space between the legs is open, said spaced legs having planar reflective surfaces which converge and diverge, said converging and diverging surfaces reflecting light entering between said spaced legs to and through said cross member, a pre-coiled indicia strip, said pre-coiled indicia strip being mounted on said light reflecting and support member with a portion of said pre-coiled indicia strip across said front surface of said light reflecting and support member to be illuminated by the light passing through said cross member, said pre-coiled indicia strip having coiled ends separated and supported by said legs on the outside of the channel while light is transmitted between the legs.

2. A display module according to claim 1 in which said light reflecting and support member is made of clear plastic.

3. A display module according to claim 2 in which the thickness of said legs is substantially uniform whereby a shallow trough is formed on the outside of each said leg, said coiled ends lying in said troughs.

4. A display module according to claim 3 in which the angles of convergence and divergence of said planar reflective surfaces of each of said legs are selected to reflect light entering the back towards the front whereby the light impinging on the back of the front surface strikes the back at a high angle of incidence and travels through the cross member.

5. A display module according to claim 4 in which the light transmitted through said cross member is substantially uniform to the observer and shows no evidence or shadows of the coils of said strip.

6. A display module comprising, a bezel having an aperture therein, means for supporting a pre-coiled indicia strip of finite length in registry with said aperture, both ends of said strip being coiled when a medial portion of said strip is in registry with said aperture whereby the coiled ends of said pre-coiled indicia strip are on either side of and behind the aperture, and a channel-like member lying on its side and transmitting light from the rear of the module to the front of the module between the legs of the channel-like member and between said coiled ends of the coiled pricing strip, each leg of said channel-like member being formed to provide a planar reflective surface at the rear of said member converging toward the other leg of the member and also including between said converging surface and the front of said member a planar reflective surface which diverges from the other leg, said converging and diverging reflective planar surfaces acting to reflect light entering the space between said legs from the rear to and through the front of said member.

7. A display module for use in conjunction with a frame comprising, a bezel to be mounted in the frame and having an aperture therein, a light reflecting and support member mounted on the back of the bezel, said light reflecting and support member having a generally U-shaped cross section lying on its side on one of its two spaced legs and with the open part of the U projecting rearwardly, each of said legs of said reflecting and support member being in the form of a shallow V whereby the space between the legs converges uniformly and then diverges uniformly going from the rear towards the front of said light reflecting and support member, said light reflecting and support member having a clear plastic surface lying behind the aperture in the bezel, a coiled plastic strip of finite length and havings ends, said strip bearing appropriate indica and extending across the front of said clear plastic surface between said surface and the bezel whereby when a medial portion of said strip extends across said front the ends of said coiled plastic strip comprise coils supported in said shallow V formed by the legs of said support member, the inside surfaces of the legs of the U-shaped member functioning to reflect light entering the space between the legs toward the front from the rear to be transmitted through said clear plastic surface to illuminate said plastic strip, said clear plastic surface being free of any shadows of said coils or grooves.

* * * * *